United States Patent [19]

Spilhaus

[11] Patent Number: 4,627,622

[45] Date of Patent: Dec. 9, 1986

[54] MAP PUZZLE HAVING PERIODIC TESSELATED STRUCTURE

[76] Inventor: Athelstan Spilhaus, P.O. Box 1063, Middleburg, Va. 22117

[21] Appl. No.: 712,364

[22] Filed: Mar. 15, 1985

[51] Int. Cl.[4] ..... A63F 9/10; G09B 29/02

[52] U.S. Cl. ..... 273/157 R; 434/135; 434/150

[58] Field of Search ..... 273/157 R; 434/130, 434/135, 137, 150, 153

[56] References Cited

U.S. PATENT DOCUMENTS

| | | | |
|---|---|---|---|
| 2,153,053 | 4/1939 | Smith | 434/135 |
| 2,353,037 | 7/1944 | Irwin | 273/157 R |
| 2,393,676 | 1/1946 | Fuller | 434/135 |
| 2,424,601 | 7/1947 | Crouch | 434/135 |
| 3,193,294 | 7/1965 | Irwin | 273/157 R |
| 3,964,749 | 6/1976 | Wadsworth | 273/157 R |

*Primary Examiner*—Anton O. Oechsle
*Attorney, Agent, or Firm*—Cesari & McKenna

[57] ABSTRACT

A puzzle comprising a planar map projection is formed from a conformal projection of the earth's surface onto an equilateral tetrahedron whose apices are located at preselected significant points on the surface, for example, major airports, major seaports, etc. The planar map puzzle is tesselated (that is, space filling) and periodic (repeating itself with, at most, changes of orientation). A plurality of frames are provided to accommodate different predefined configurations of the puzzle pieces to thereby illustrate differing features of the respective configurations.

17 Claims, 4 Drawing Figures

MAP PUZZLE HAVING PERIODIC TESSELATED STRUCTURE

BACKGROUND OF THE INVENTION

A. Field of the Invention

The invention relates to puzzles, especially to map puzzles. In particular, it comprises a map puzzle formed from a planar map projection having a plurality of separable pieces which fit together in a variety of periodic, tesselated configurations, each enclosable within a frame specifically configured to that configuration, to illustrate specific features associated with the respective configurations.

B. Prior Art

Map puzzles are frequently used for entertainment purposes, as well as for instruction. Their utility for the latter purpose, however, is usually limited, since a given puzzle commonly can be assembled in only a single configuration. Further, the common map projections, while reasonably useful for many geopolitical purposes, contain significant distortions with respect to land sizes and locations that arise from the particular projection technique that is utilized.

Spherical surfaces such as maps of the earth's suface have commonly been projected onto two-dimensional (planar) surfaces by a variety of projective techniques. One common projective technique is that of projection from a point located at the earth's center onto a cylindrical surface that is positioned tangent to the earth at a selected point, usually the equator. This form of projection, known as "cylindrical central projection," distorts both parallels of latitude and parallels of longitude.

A modified form of this projection introduces a controlled distortion of the distance between parallels of latitude with increasing distance from the equator to maintain a conformal relationship in the projection (that is, lines of latitude remain parallel to lines of longitude, and the shape of small areas is preserved), but does so at the expense of distorting the size of areas on the map, particularly as one departs from the equator. Nonetheless, this map is commonly used, particularly for geopolitical maps, and is known as the Mercator projection. Other, less commonly used projections include stereographic projections (the spherical surface of the earth is projected onto a plane tangent to the earth at the given point); conic projections (projections onto conical surfaces); and polyhedral projections (projections onto polyhedral surfaces). With respect to the latter, the work of Schwartz has shown that a conformal projection onto an equilateral tetrahedron has a number of advantages in preserving conformality, as well as relative sizes.

BRIEF SUMMARY OF THE INVENTION

OBJECTS OF THE INVENTION

Accordingly, it is an object of the invention to provide an improved map puzzle.

Further, it is an object of the invention to provide a map puzzle that can be put together in a variety of ways, each illustrating a particular feature of the specific configuration.

Still a further object of the invention is to provide a map puzzle that is arrangeable in a variety of configurations, each associated with a frame that is specific to that configuration.

BRIEF DESCRIPTION OF THE INVENTION

In accordance with the present invention, I provide a two-dimensional, planar map puzzle that is configurable in a variety of configurations and that has the property that each is tesselated (that is, the puzzle pieces fill the space within the boundaries of the particular configurations into which the pieces are arranged without gaps within the interior of the boundaries) and is periodic (that is, a duplicate projection nests with the first projection to form a larger piece that itself is tesselated).

The puzzle is formed by projecting the spherical map of the earth onto an equilateral tetrahedron whose apices are located in the vicinity of selected points on the spherical surface corresponding to "significant" points for purposes of the projection. For example, to illustrate the major land masses and sea areas of the earth, a useful set of significant points would be located along the coastlines in the vicinity of the Bering Strait in Alaska; the coast of Chile or Peru; equatorial Africa, on the east coast; and the west coast of Australia, near Sydney. For purposes of illustrating travel between major cities of the world, the apices may be located near major airports of the world; corresponding selection would be made of major seaports, for purposes of illustrating sea travel, and so forth. The major tectonic plates of the world may be illustrated by locating the apices adjacent junctions of tectonic plate boundaries.

As a consequence of the periodic, tesselated nature of the projection, the resultant planar projection of the spherical surface can be divided arbitrarily into a plurality of separable pieces of arbitrary shape which can be reassembled not only into the tesselated contour of the original projection, but also into a plurality of other contours, each itself tesselated, and each illustrating a different aspect of the map. For each of these contours there is preferably provided a surrounding frame into which a given contour uniquely fits. This not only guides the user in assembling the puzzle pieces into a particular configuration, but may also be used to provide information specific to the particular configuration. For example, each contour preferably has indicia imprinted or otherwise formed thereon showing certain characteristics advantageously illustrated by the specific configuration with which the frame is associated.

BRIEF DESCRIPTION OF THE DRAWINGS

The foregoing and other and further objects and features of the invention will be more readily understood from the following detailed description of the invention, when taken in conjunction with the accompanying diagrams in which.

DETAILED DESCRIPTION OF THE INVENTION

Figure 1A:
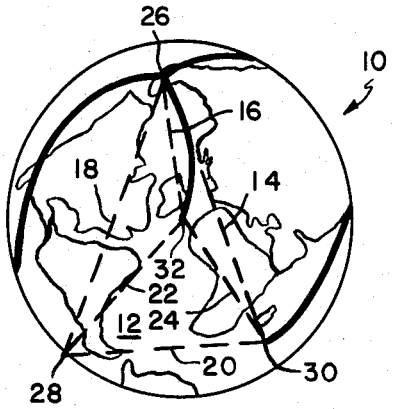
FIGS. 1A and 1B are sketches illustrating the manner in which a spherical surface is projected onto an equilateral tetrahedron whose apices are located near significant points of the spherical surface in accordance with the present invention.

In FIG. 1A, a spherical map 10 of the world, that is, a globe, has inscribed therein a polyhedron 12, preferably an equilateral tetrahedron (shown in link lines) formed by edges 14, 16, 18, 20, 22, 24 connecting apices 26, 28, 30, and 32. The apices are chosen to coincide with "significant" points, that is, points of major interest on the earth in relation to the purpose which the puzzle is intended to serve. For example, as previously described, in forming puzzle maps focusing on the oceans, the "significant points" are preferably chosen along coastlines so as to obtain a projection that largely leaves the oceans intact.

After the tetrahedron is suitably positioned within the sphere of the globe 10, a conformal projection of the surface of the sphere onto the tetrahedron is performed. Techniques for such projections are known to those in the cartographic field: see, for example, "The Conformal Tetrahedric Projection with Some Practical Applications," L. P. Lee, *Cartographic Journal,* 1973. The tetrahedron may then be "unfolded" to provide a planar surface comprising the desired projection of the earth's spherical surface.

Figure 1B:
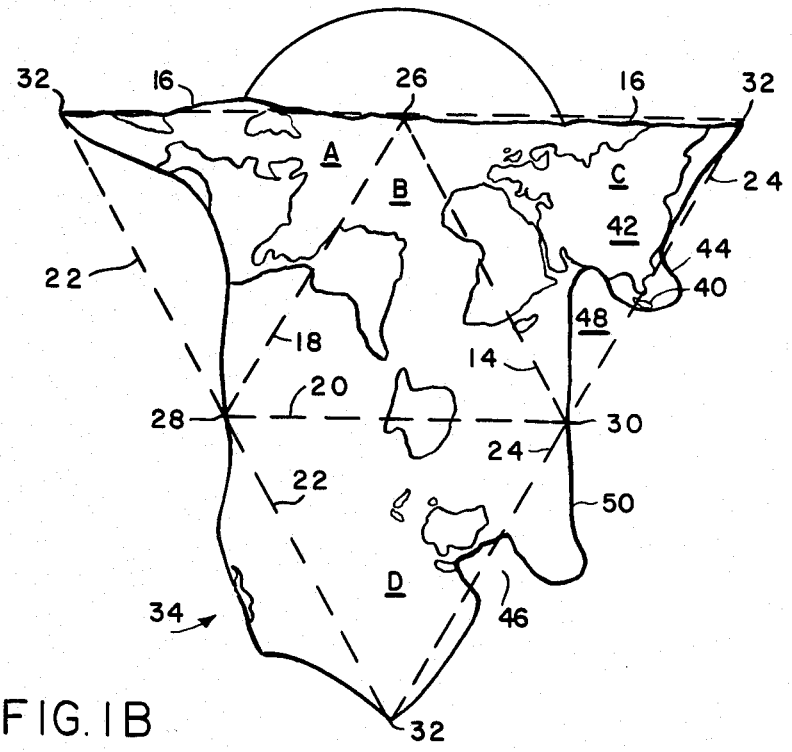

Thereafter, the tetrahedral surface is "unfolded" into a planar surface 34 of triangular shape as shown in FIG. 1B. The resultant surface is in the form of an equilateral triangle formed from four "interior" equilateral triangles designated "A," "B," "C," and "D," respectively in FIG. 1B. This shape is then modified in such a manner as to preserve intact, within the confines of the resultant outline, certain selected features.

For example, the land mass 40 in triangle "C" may be kept associated with land mass 42 by forming an outward extension 44 beyond the triangular boundary. This extension is compensated for by a corresponding inward incursion 46 in the adjacent triangular panel "D." Likewise, the incursion 48 in panel "C" is compensated by the extension 50 in panel "D." In general, incursions or extensions with respect to an edge (e.g., edge 24) in one panel (e.g., panel "C") are compensated by corresponding extensions or incursions along the same edge of an adjacent panel (here, panel "D"). In particular, the shape along an exterior edge of a panel is obtained by rotating an adjacent panel by 180° about the common apex between the two panels until the common exterior edges of the panels overlap. For example, the shape along exterior edge 24 of panel "C" is obtained by rotating panel "C" by 180° about apex 30 to coincide with edge 24. Similarly, rotation of panel "D" about apex 28 will define the shape along edge 22 of panel "A," while rotation of panel "A" about apex 26 will define the shape of panel "C" along edge 16.

When these modifications are made in the manner described, the map can be cut into a number of pieces of arbitrary shape, and the resultant will be found to maintain the properties of periodicity and tesselation. Thus, it can be rearranged and yet maintain a correct fit of all the pieces. For purposes of illustration, two such configurations are shown in FIG. 2.

Figure 2A:
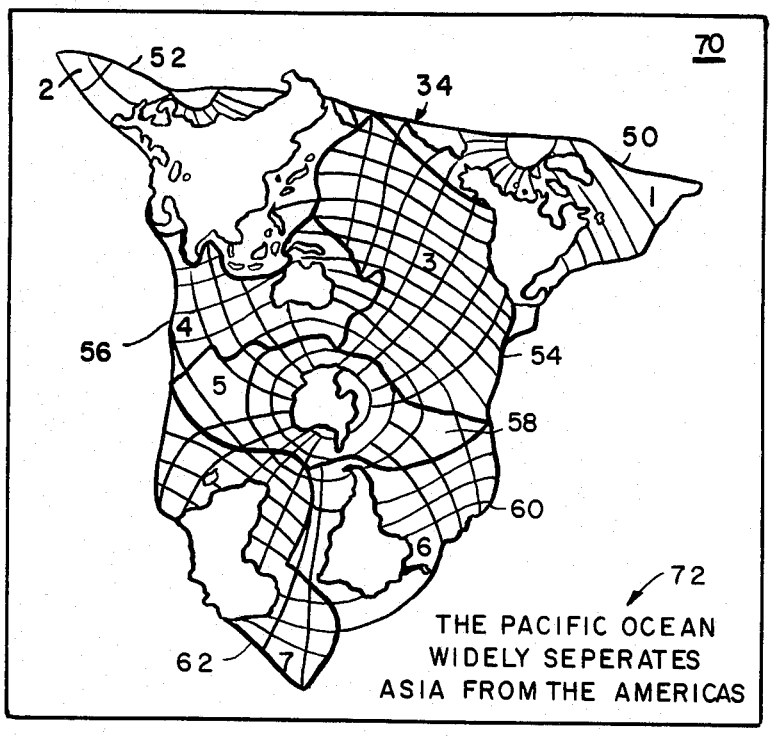
FIGS. 2A and 2B show two of the several possible configurations of the projection of FIG. 1 in the form of map puzzles, each fitted in an appropriate frame.

In FIG. 2A, the projection 34 of FIG. 1 is shown divided into seven "puzzle" pieces 50–62, respectively, of arbitrary shape. While the number of pieces into which the projection 34 is cut, and the shape of the individual pieces, is wholly at the discretion of the producer, the formation will generally be guided by the particular purpose for which the puzzle is being constructed. For example, where the relation of land masses to each other is an important consideration in the resultant puzzle, the cuts should be arranged so that each land mass is preserved intact.

Figure 2B:
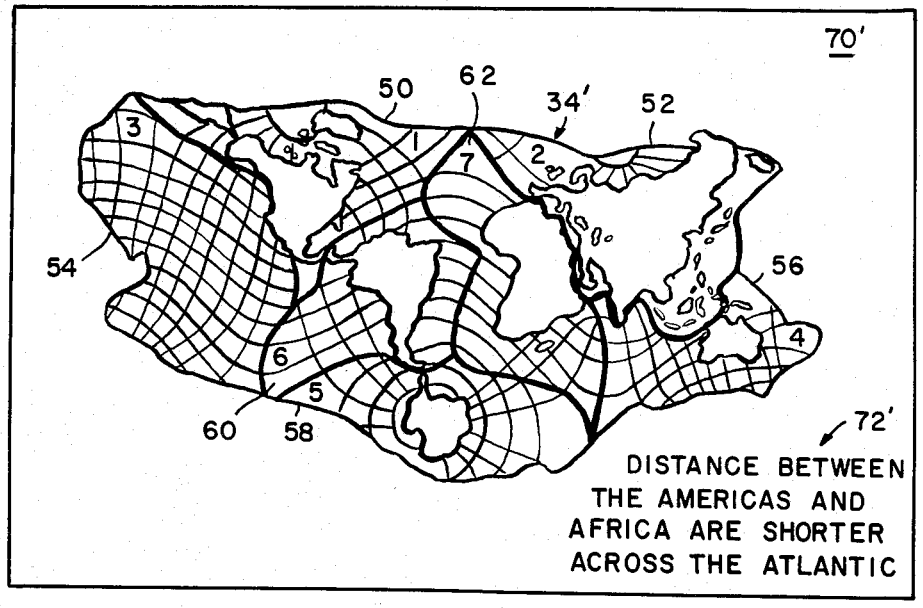

The resultant puzzle is preferably incorporated within a frame 70 that serves to guide the user, particularly the novice, in assembling the pieces. The frame may comprise a single continuous piece with an interior cutout to accomodate the map pieces in a given configuration as shown in FIGS. 2A and 2B, or may itself be formed of interlocking pieces. Further, the frame desirably contains indicia that are specific to the particular configuration corresponding to the frame and that provide the user further information about the representation shown in relation to that frame. For example, in FIG. 2A, the particular configuration shown illustrates the orientation of the major land masses of the earth with particular emphasis on the orientation of the American and Asian continents with respect to the Pacific Ocean. Suitable indicia to this effect is inscribed at 72 on the frame 70.

As noted previously, the projections illustrated here are periodic and tesselated. Accordingly, they may be rearranged in a variety of ways and, when so rearranged, present a different, but equally valid, viewpoint of the features of the earth. Thus, in FIG. 2B, the separate pieces 50–62 of the puzzle of FIG. 2A are rearranged into a new configuration in which the land masses of North and South America, on the one hand, and those of Europe, Asia, and Africa on the other, are maintained in associated groupings, while the vastness of the Pacific Ocean has been set off to the left of the map.

It will be understood that various changes may be made in the foregoing without departing from either the spirit or the scope of the invention and that the foregoing is thus to be taken as illustrative of the preferred embodiment of the invention, the invention being defined with particularity in the claims.

I claim:

1. A map puzzle in the form of a plurality of separable interfitting pieces, the pieces obtained by:

projecting a spherical map onto a polyhedral surface having apices located adjacent preselected significant points on said spherical map, said significant points corresponding to selected locations represented on said spherical map to define planar projected figures of said spherical map on the sides of said polyhedron that enclose areas of said spherical map which are to be emphasized;

unfolding said polyhedral surface; and arbitrarily dividing the resultant unfolded polyhedral projection into the plurality of arbitrarily shaped interfitting pieces so that when assembled the pieces form a single tesselated representation of said spherical map.

2. A map puzzle according to claim 1 in which said apices are located adjacent the coastlines of continents.

3. A map puzzle according to claim 1 in which said apices are located adjacent the junctions of tectonic plates.

4. A map puzzle according to claim 1 in which said significant points comprise major cities having characteristics relating the map to a predefined purpose.

5. A map puzzle according to claim 1 in which said significant points comprise cities having major airports.

6. A map puzzle according to claim 1 in which said significant points comprise cities having major seaports.

7. A map puzzle according to claim 1 in which the surfaces onto which said spherical map is projected comprises a tetrahedron.

8. A map puzzle according to claim 1 in which said tetrahedron is formed of equilateral triangles.

9. A map puzzle according to claim 8 in which said significant points comprise major cities having characteristics relating the map to a predefined purpose.

10. A map puzzle according to claim 1 in which said puzzle pieces are divided from said unfolded polyhedral projection, so that each puzzle piece has an arbitary shape that depicts at least one selected uninterrupted feature of said spherical map.

11. A map puzzle according to claim 1 including at least one frame for receiving the puzzle pieces therein form a complete planar surface when the puzzle pieces are fitted together therein in a predetermined configuration.

12. A map puzzle according to claim 1 which includes a plurality of frames, each frame with a different interior cutout for receiving a unique arrangment of all of said puzzle pieces in a tesselated manner therein, to form a complete planar map from said puzzle pieces, so that each planar map emphasizes a different aspect of the areas of said spherical map.

13. A map puzzle according to claim 12 including means identifying each frame with a major characteristic to be illustrated by the particular configuration of said map pieces associated with said frame.

14. A map puzzle according to claim 12 in which the surface on which said spherical map is projected comprises a tetrahedron formed from equilateral triangles.

15. A map puzzle according to claim 12 in which said polyhedral surface comprises an equilateral tetrahedron.

16. A map puzzle according to claim 12 in which said apices are located adjacent the coastlines of continents.

17. A map puzzle according to claim 12 in which said apices are located adjacent the junctions of tectonic plates.

* * * * *